US009716363B2

(12) United States Patent
Saitoh

(10) Patent No.: US 9,716,363 B2
(45) Date of Patent: Jul. 25, 2017

(54) CONNECTOR AND MANUFACTURING METHOD THEREOF

(71) Applicant: YAZAKI CORPORATION, Tokyo (JP)

(72) Inventor: Masayuki Saitoh, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/139,541

(22) Filed: Apr. 27, 2016

(65) Prior Publication Data

US 2016/0322719 A1 Nov. 3, 2016

(30) Foreign Application Priority Data

Apr. 30, 2015 (JP) ..... 2015-093012

(51) Int. Cl.
*H01R 11/09* (2006.01)
*H01R 43/24* (2006.01)

(52) U.S. Cl.
CPC ..... *H01R 43/24* (2013.01); *H01R 2201/26* (2013.01)

(58) Field of Classification Search
CPC ..... H01R 9/24; H01R 9/2483; H01R 4/34; H01R 43/24; H01R 13/504; H01R 43/18; H01R 24/30; H01R 13/5216; H01R 13/5202; Y10T 29/49222; Y10T 29/4922
See application file for complete search history.

(56) References Cited

U.S. PATENT DOCUMENTS

| | | | | |
|---|---|---|---|---|
| 9,211,852 | B2 * | 12/2015 | Omori | H01R 4/64 |
| 9,362,665 | B2 * | 6/2016 | Omori | H01R 4/64 |
| 2016/0322719 | A1 * | 11/2016 | Saitoh | H01R 43/24 |
| 2016/0322727 | A1 * | 11/2016 | Suzuki | H01R 11/01 |

FOREIGN PATENT DOCUMENTS

| | | | |
|---|---|---|---|
| JP | 2005-174697 | A | 6/2005 |
| JP | 2013-82256 | A | 5/2013 |
| JP | 2013-105659 | A | 5/2013 |
| JP | 2014-89811 | A | 5/2014 |

* cited by examiner

*Primary Examiner* — Xuong Chung Trans
(74) *Attorney, Agent, or Firm* — Kenealy Vaidya LLP

(57) ABSTRACT

A connector includes: a connecting member including a plurality of tab sections and made of a conductive metal material; and a housing which is made of resin and in which the connecting member is insert-molded. Terminals of a counterpart connector are connectable to the tab sections by a connection of the counterpart connector. A side of the connecting member of the housing opposite to a protruding direction of the tab sections is used as a resin charging gate section from which the resin is charged.

2 Claims, 10 Drawing Sheets

CONNECTOR AND MANUFACTURING METHOD THEREOF

CROSS REFERENCE TO RELATED APPLICATION(S)

This application is based on and claims priority from Japanese Patent Application (Application No. 2015-093012) filed on Apr. 30, 2015, the entire contents of which are incorporated herein by reference.

BACKGROUND

1. Field of the Invention

One or more embodiments of the present invention relate to a connector provided with an integrated connecting member and to a manufacturing method thereof.

2. Description of the Related Art

As a joint connector for connecting a plurality of electric wires collectively to the grounding portion of a vehicle, a connector is available in which a connecting member, such as a conductive plate, having a plurality of terminal sections to which electric wire side terminals are connected, is integrated with the housing of the connector (for example, refer to JP-A-2013-082256, JP-A-2013-105659, and JP-A-2014-089811).

This kind of connector equipped with a connecting member is manufactured by injecting molten resin into a mold in a state in which the connecting member is set inside the mold so that the connecting member is integrally molded with the resin (for example, refer to JP-A-2005-174697).

SUMMARY

However, when the molten resin is injected into the mold, the charging pressure of the molten resin is applied to the connecting member held inside the mold. Hence, the position of the connecting member held inside the mold is changed by the charging pressure of the resin, and the positional accuracy of the terminal sections of the connecting member with respect to the housing is lowered, whereby at the time of the connection to a counterpart connector, the connection to the electric wire side terminals of the counterpart connector may be hindered.

One or more embodiments of the present invention are made in consideration of the above-mentioned circumstances, and an object thereof is to provide a connector in which a connecting member can be disposed accurately and integrated and to provide a manufacturing method thereof.

The above-described objection of one or more embodiments of the present invention can be achieved by the following configuration.

(1) A connector including: a connecting member including a plurality of tab sections and made of a conductive metal material; and a housing which is made of resin and in which the connecting member is insert-molded, wherein terminals of a counterpart connector are connectable to the tab sections by a connection of the counterpart connector, and wherein a side of the connecting member of the housing opposite to a protruding direction of the tab sections is used as a resin charging gate section from which the resin is charged.

(2) A manufacturing method of a connector, the connector including: a connecting member including a plurality of tab sections and made of a conductive metal material; and a housing which is made of resin and in which the connecting member is insert-molded, wherein terminals of the counterpart connector being connected to the tab sections by the connection of the counterpart connector, the manufacturing method comprising: holding the connecting member in a mold for molding the housing; and molding the housing by charging molten resin into the mold from a gate provided in the mold on a side of the connecting member opposite to a protruding direction of the tab sections.

With the connector configured as described in the above-mentioned item (1), the side of the connecting member of the housing on the opposite side in the protruding direction of the tab sections is used as the resin charging gate section from which the resin is charged, whereby the charging pressure of molten resin during the molding of the housing is applied in the protruding direction of the tab sections of the connecting member. Hence, the positions of the tab sections do not become unstable, the tab sections are not inclined and the extending length thereof does not become insufficient due to the charging pressure of the molten resin. As a result, the tab sections are disposed accurately at predetermined positions, a satisfactory state of the connection to the terminals of the counterpart connector can be secured at the time of the connection to the counterpart connector, and high connection reliability can be obtained.

With the manufacturing method of the connector configured as described in the above-mentioned item (2), the housing is molded by charging the molten resin into the molds from the gate provided on the side of the connecting member on the opposite side in the protruding direction of the tab sections, whereby the charging pressure of the molten resin during the molding of the housing is applied in the protruding direction of the tab sections of the connecting member. Hence, the positions of the tab sections do not become unstable, the tab sections are not inclined and the extending length thereof does not become insufficient due to the charging pressure of the molten resin. As a result, the tab sections are disposed accurately at predetermined positions, a satisfactory state of the connection to the terminals of the counterpart connector can be secured at the time of the connection to the counterpart connector, whereby a connector having high connection reliability can be manufactured.

One or more embodiments of the present invention can provide a connector in which a connecting member can be disposed accurately and integrated and can provide a manufacturing method thereof.

One or more embodiments of the present invention has been described above briefly. The details of the present invention will be further clarified by reading the descriptions of the mode (hereafter referred to as "embodiment") for embodying the invention to be described below referring to the accompanying drawings.

BRIEF DESCRIPTION OF THE DRAWINGS

FIG. 4A is a perspective view seen from the tip end side of the connector, and FIG. 4B is a perspective view seen from the rear end side thereof;

FIG. 5A is a front view, and FIG. 5B is a rear view;

FIG. 6A is a sectional view taken on line A-A of FIG. 5A, and FIG. 6B is a sectional view taken on line B-B of FIG. 5A;

FIG. 7A is a perspective view seen from the tip end side thereof, 7B is a perspective view seen from the rear end side thereof, and FIG. 7C is a rear view;

FIG. 10A is a perspective view showing the connector, and FIG. 10B is a horizontal sectional view showing the connector.

DETAILED DESCRIPTION

Figure 1:
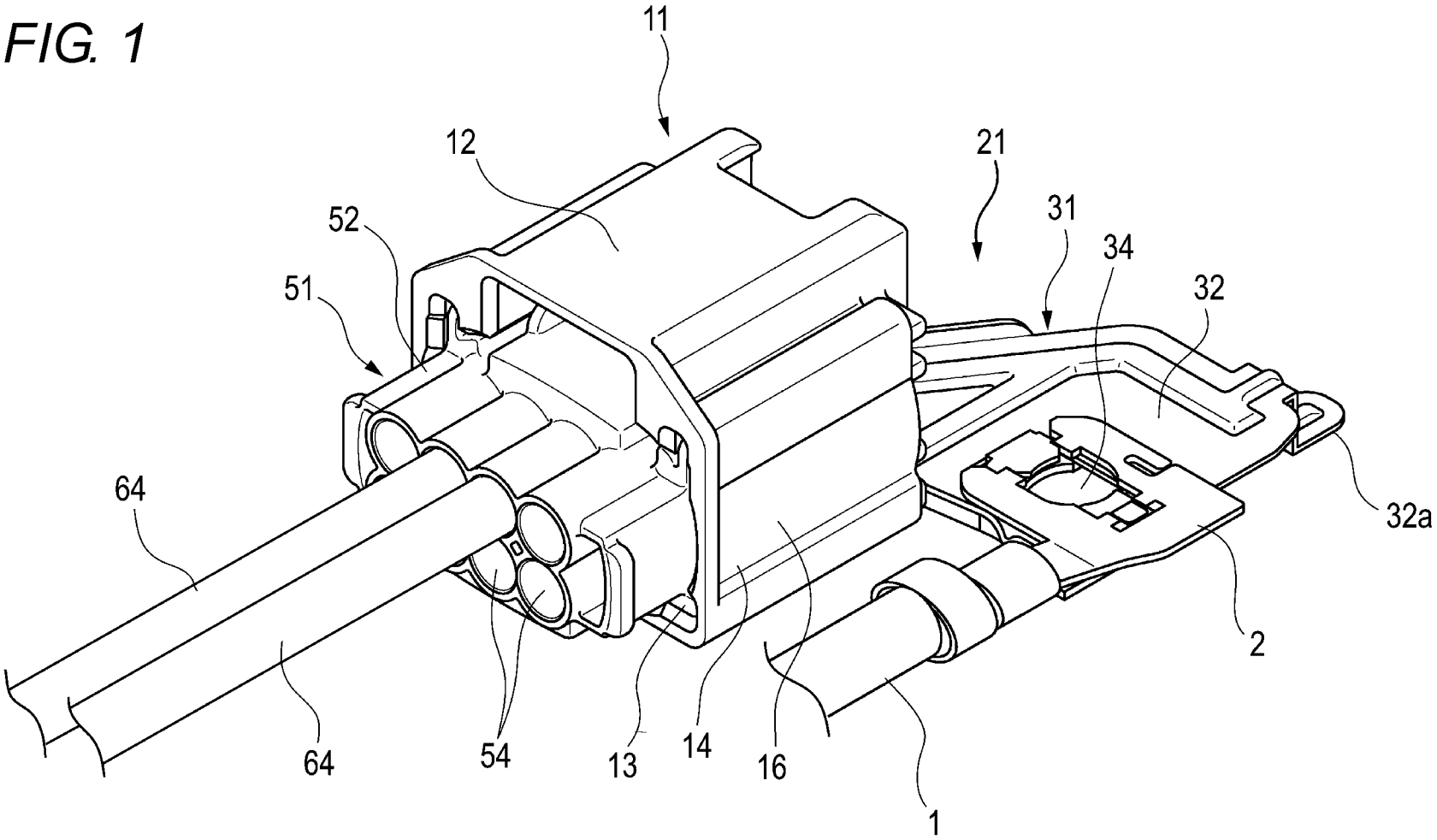
FIG. 1 is a perspective view showing a connector according to an embodiment to which a counterpart connector is connected.

An embodiment according to the present invention will be described below referring to the drawings.

Figure 2:
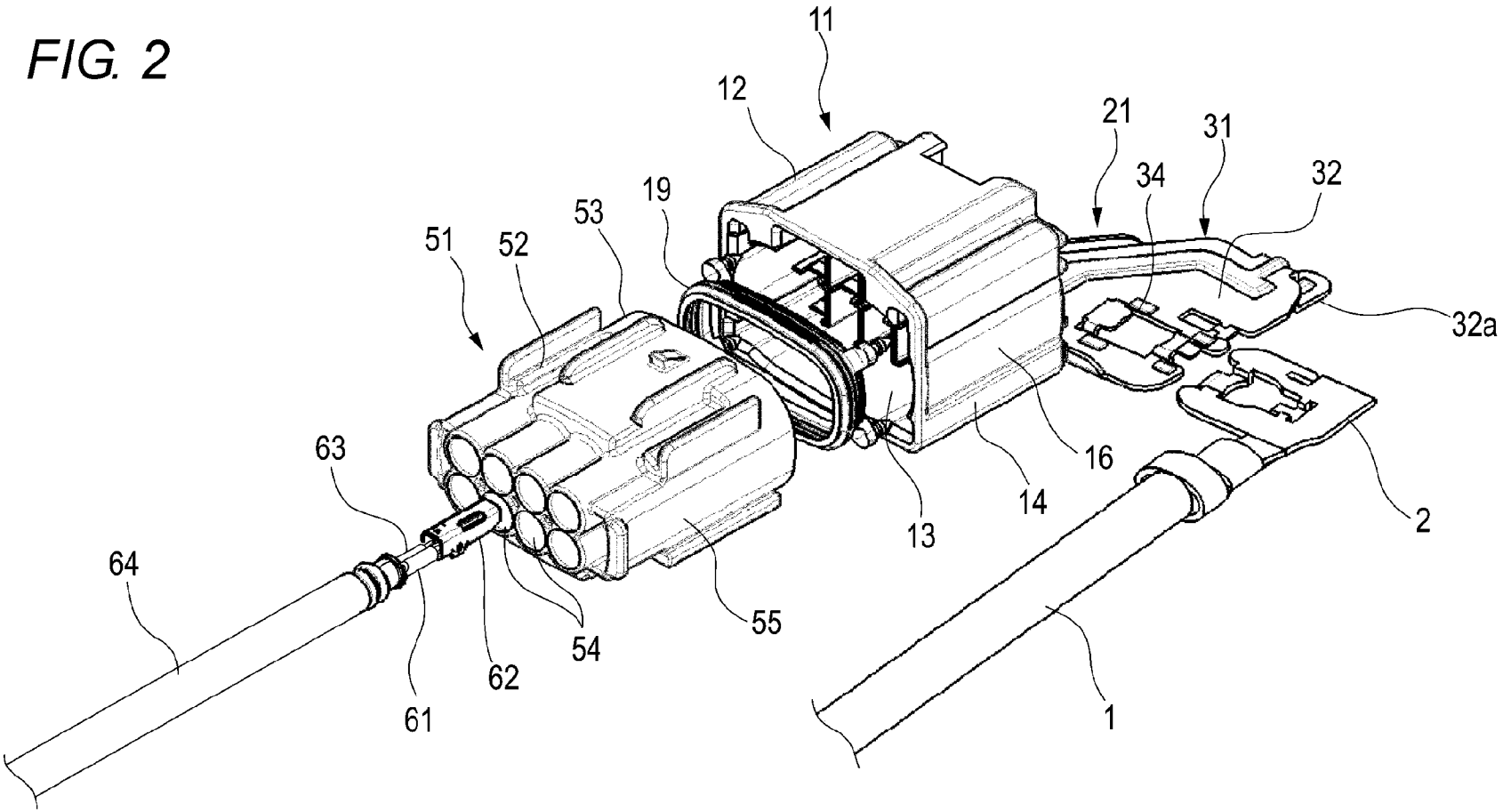
FIG. 2 is an exploded perspective view showing the connector according to the embodiment and the counterpart connector.

FIG. 1 is a perspective view showing a connector according to an embodiment to which a counterpart connector is connected. FIG. 2 is an exploded perspective view showing the connector according to the embodiment and the counterpart connector.

As shown in FIGS. 1 and 2, a counterpart connector 51 is connected to a connector 11 according to the embodiment.

The connector 11 is equipped with a male housing (housing) 12 made of resin, and the counterpart connector 51 is equipped with a female housing 52 made of resin.

A fitting concave section 13 being open on the tip end side of the male housing 12, that is, on the front side thereof in the direction of connection to the counterpart connector 51, is formed in the male housing 12, and the tip end side of the female housing 52, that is, the front side thereof in the direction of connection to the connector 11, is used as a fitting section 53. Furthermore, the fitting section 53 of the female housing 52 is fitted into the fitting concave section 13 of the male housing 12, whereby the counterpart connector 51 is connected to the connector 11.

Figure 3:
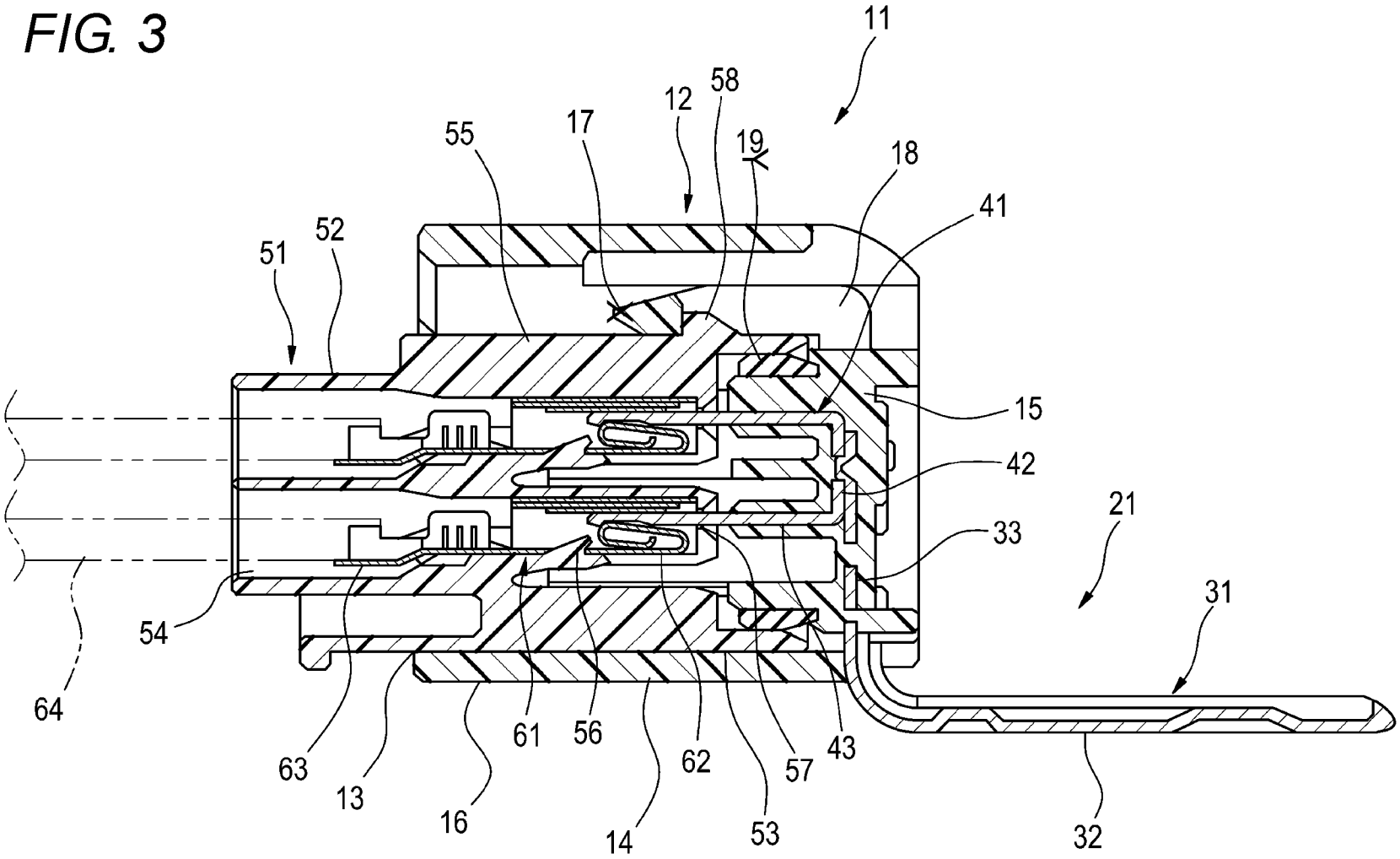
FIG. 3 is a sectional view showing a state in which the counterpart connector is connected to the connector according to the embodiment.

FIG. 3 is a sectional view showing a state in which the counterpart connector is connected to the connector according to the embodiment.

As shown in FIG. 3, the female housing 52 of the counterpart connector 51 has a housing body 55 in which a plurality of terminal housing chambers 54 are formed, and the tip end side of the housing body 55 is used as the fitting section 53. These terminal housing chambers 54 are formed along the direction of connection to the connector 11. The terminal housing chambers 54 are arranged in the width direction of the housing body 55 and further arranged in two stages in the vertical direction. Each terminal housing chamber 54 has a lance section 56 protruding from the lower side. Each terminal housing chamber 54 has an opening section 57 on the tip end side of the housing body 55. Furthermore, in the female housing 52, an engaging claw 58 is formed on the upper face of the housing body 55.

A female terminal (terminal) 61 is housed in the terminal housing chamber 54 from the rear end side thereof, that is, from the rear side thereof in the connection direction. The female terminal 61 is, for example, made of a conductive metal material, such as copper or copper alloy, and has an electrical connection section 62 and a crimping section 63. An electric wire 64 having a conductor covered with an outer coat is crimped at the crimping section 63, thereby being conducted and connected thereto. The female terminal 61 is inserted into the terminal housing chamber 54 from the rear end side of the housing body 55, whereby the electrical connection section 62 is engaged with the lance section 56. As a result, the female terminal 61 is held in a state of being housed in the terminal housing chambers 54.

Figure 4A:
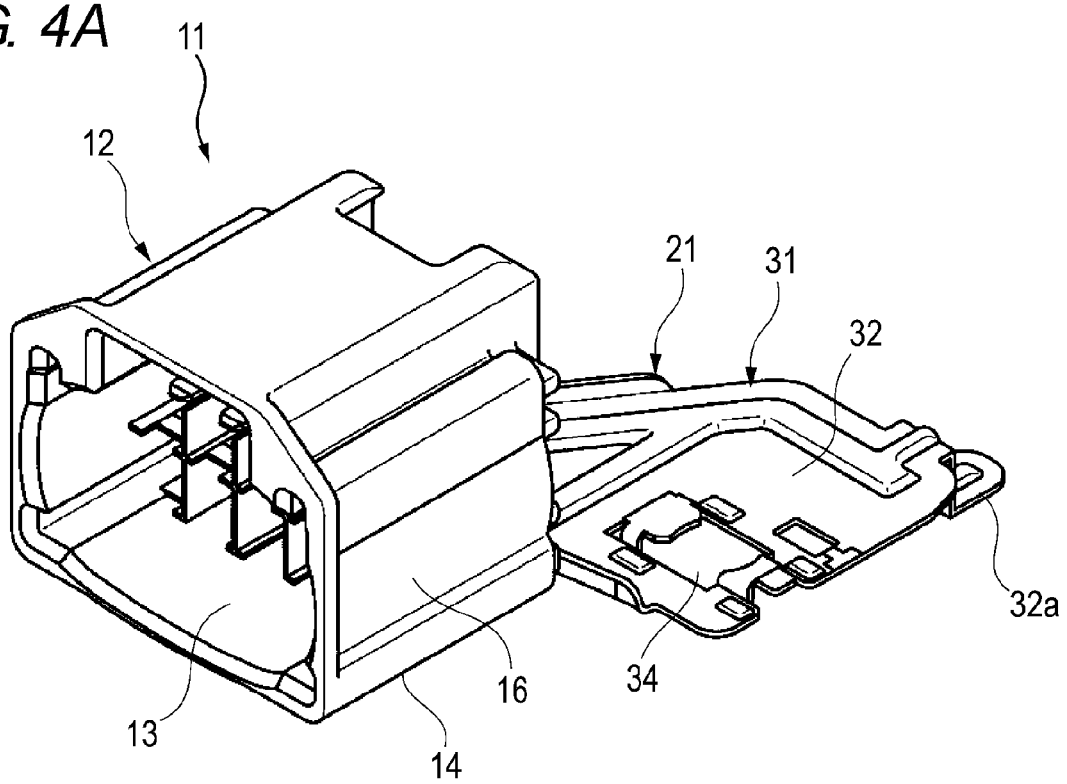
FIGS. 4A and 4B are views showing the connector according to the embodiment.
Figure 4B:
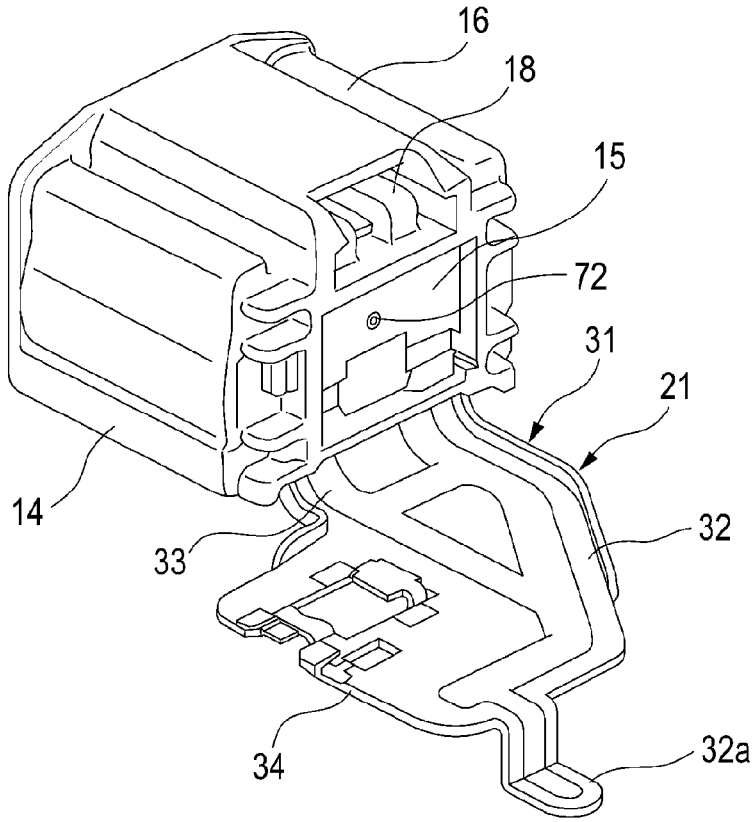
Figure 5A:
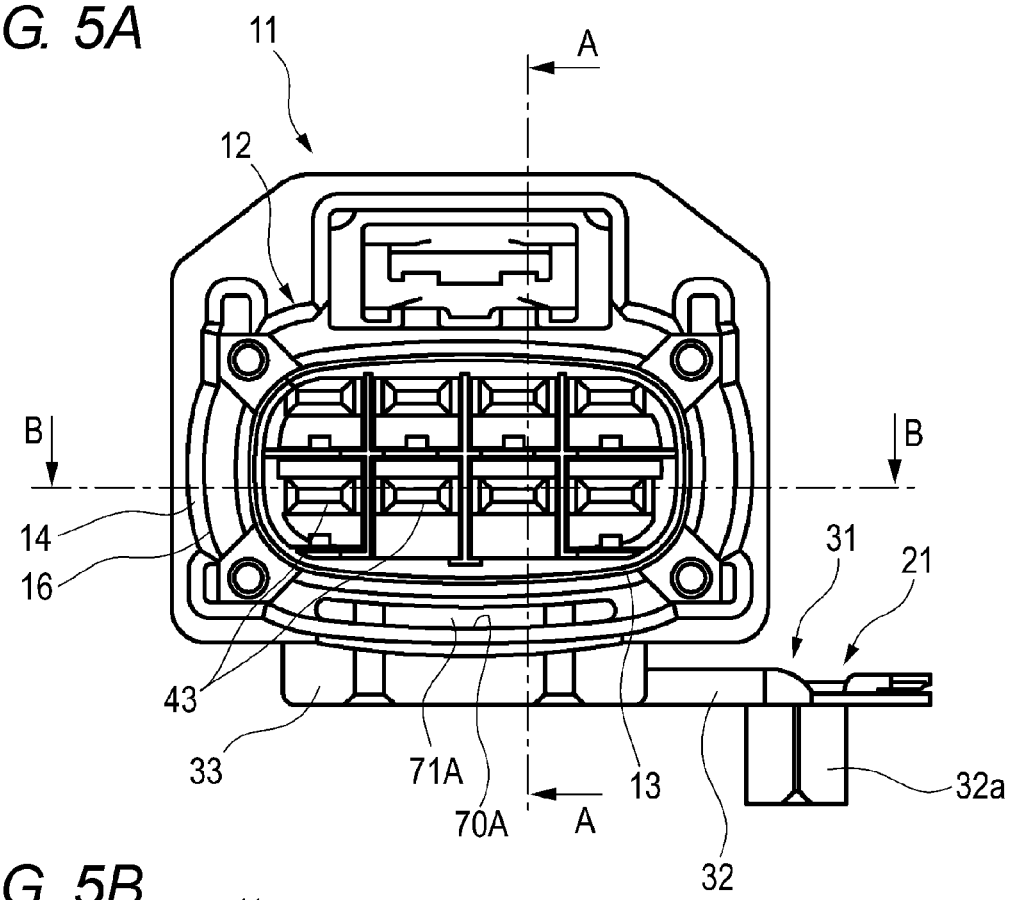
FIGS. 5A and 5B are views showing the connector according to the embodiment.
Figure 5B:
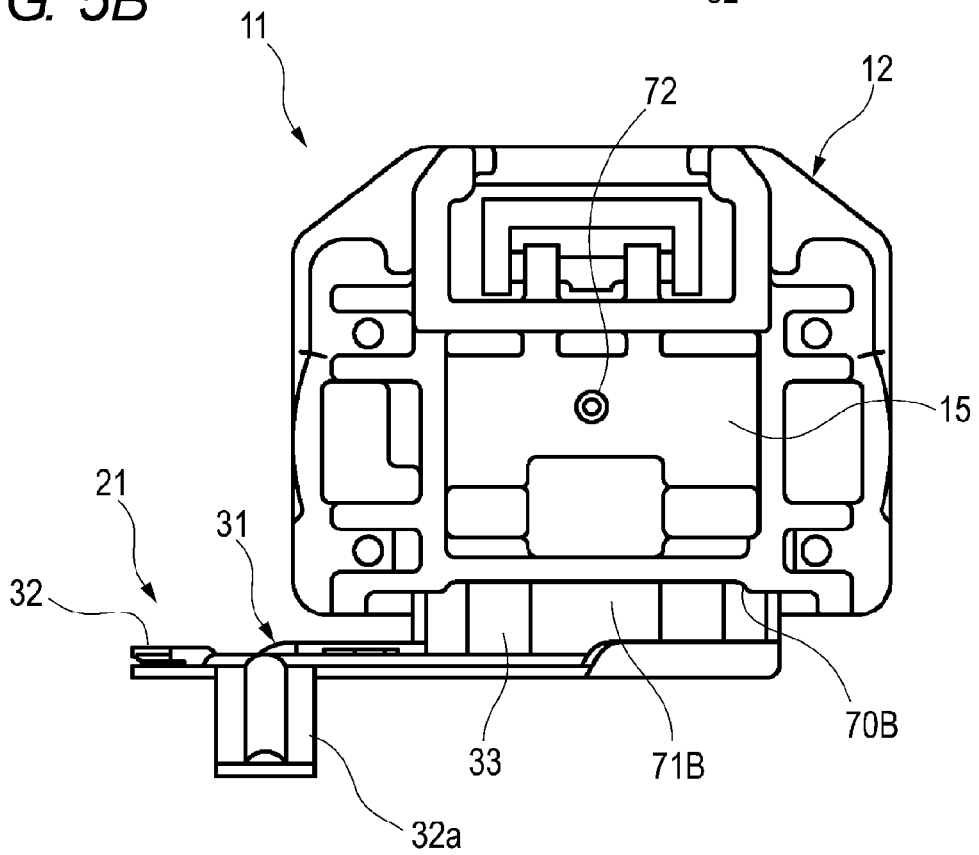
Figure 6A:
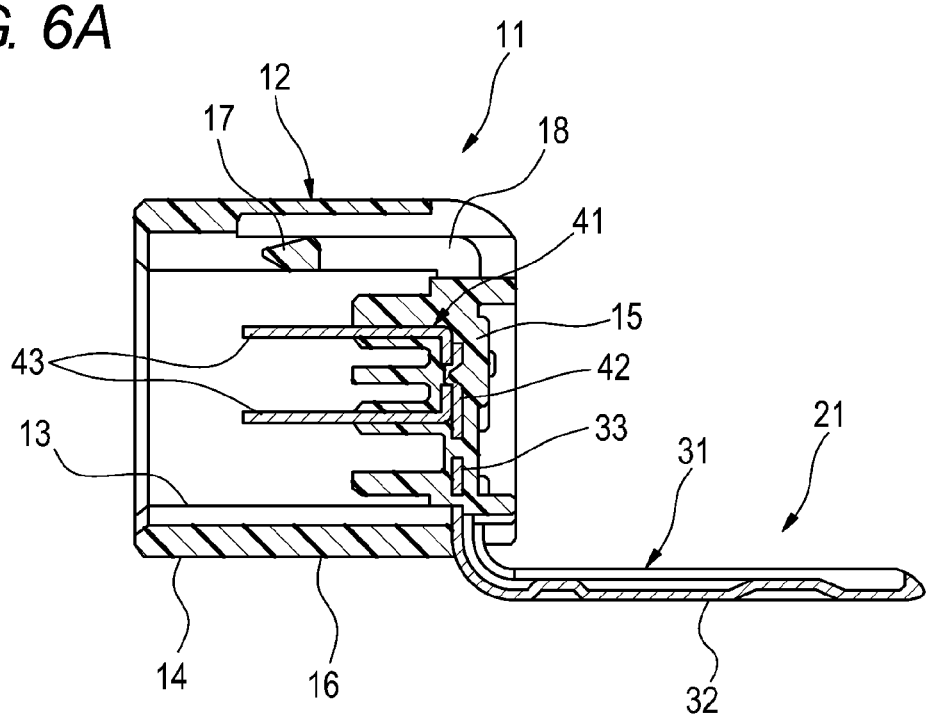
FIGS. 6A and 6B are views showing the connector according to the embodiment.
Figure 6B:
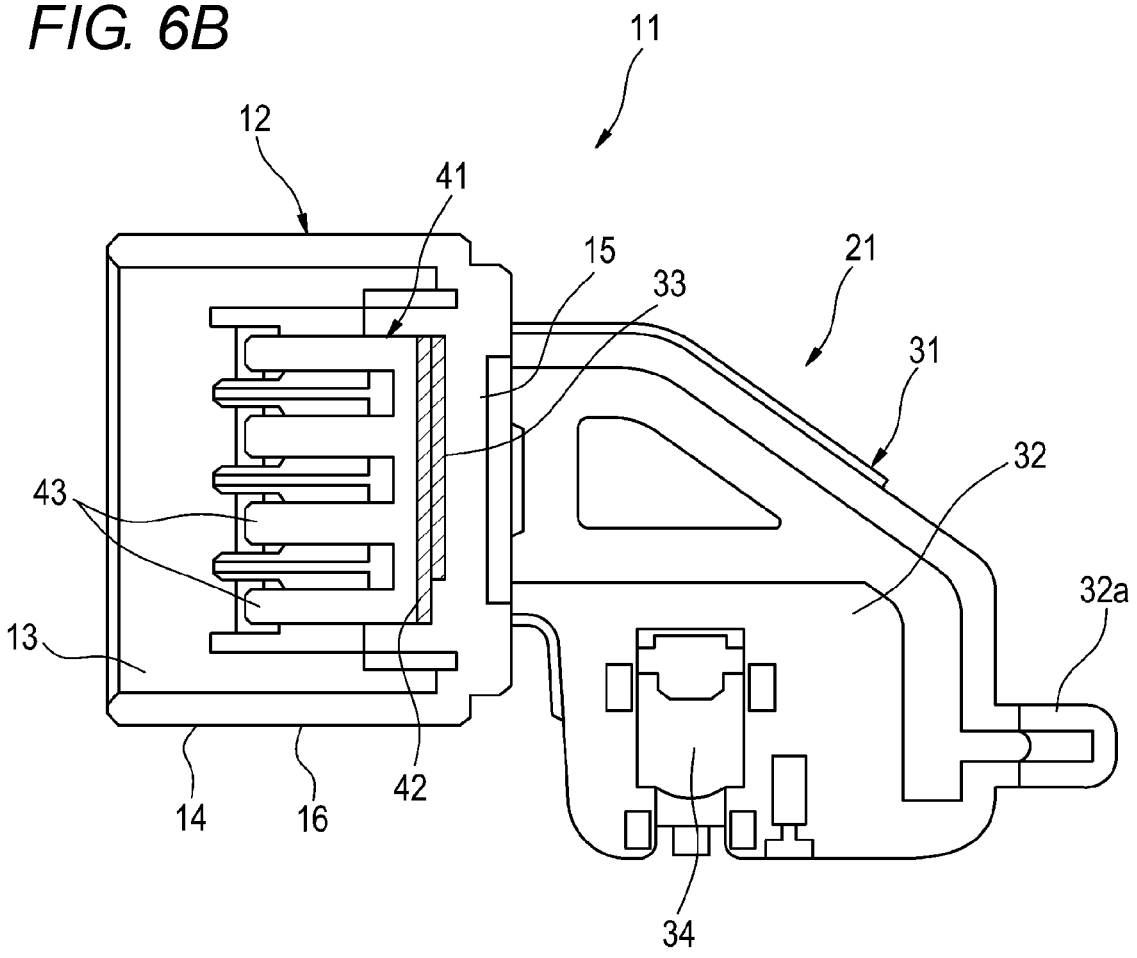

FIGS. 4A and 4B are views showing the connector according to the embodiment; FIG. 4A is a perspective view seen from the tip end side of the connector, and FIG. 4B is a perspective view seen from the rear end side thereof. FIGS. 5A and 5B are views showing the connector according to the embodiment; FIG. 5A is a front view, and FIG. 5B is a rear view. FIGS. 6A and 6B are views showing the connector according to the embodiment; FIG. 6A is a sectional view taken on line A-A of FIG. 5A, and FIG. 6B is a sectional view taken on line B-B of FIG. 5A.

The connector 11 has the male housing 12 and a connecting member 21 as shown in FIGS. 4A and 4B, FIGS. 5A and 5B, and FIGS. 6A and 6B.

The male housing 12 has a hood section 14, and the inside of this hood section 14 is used as the fitting concave section 13. The hood section 14 has a bottom wall 15 and a peripheral wall 16 extending from the peripheral edges of this bottom wall 15 to the tip end side. Furthermore, in the male housing 12, a locking arm 18 is formed in the upper section inside the fitting concave section 13. In this locking arm 18, the engaging claw 58 of the female housing 52 fitted in the fitting concave section 13 is engaged with the engaging section 17, whereby the connection state of the female housing 52 to the male housing 12 is maintained. Moreover, in the male housing 12, a packing 19 formed into a ring shape is fitted inside the hood section 14 (see FIGS. 2 and 3). When the fitting section 53 of the female housing 52 is fitted in the fitting concave section 13 of the male housing 12, this packing 19 is used to stop water from penetrating between the fitting concave section 13 and the fitting section 53.

Figure 7A:
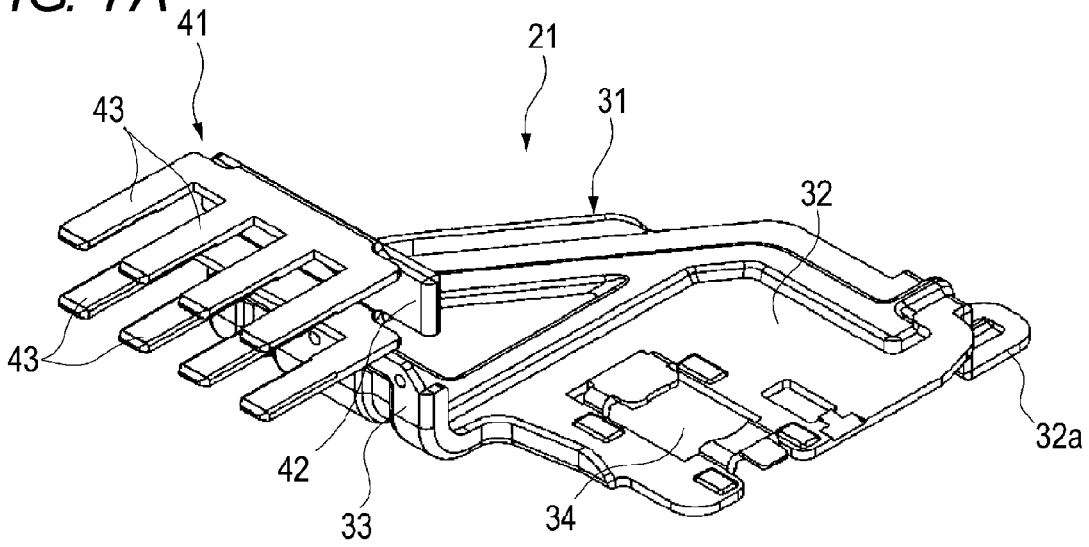
FIGS. 7A to 7C are views showing a connecting member constituting the connector according to the embodiment.
Figure 7B:
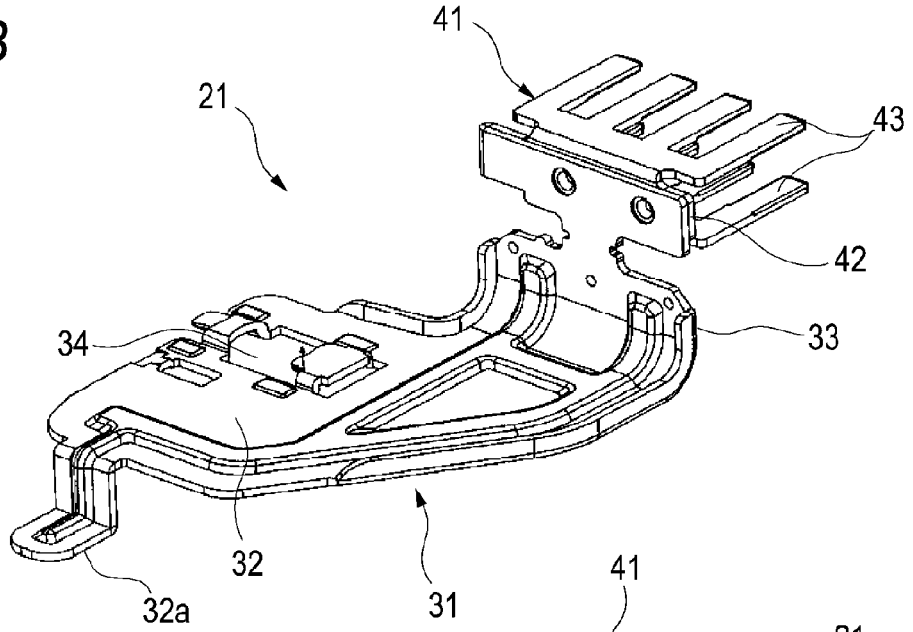
Figure 7C:
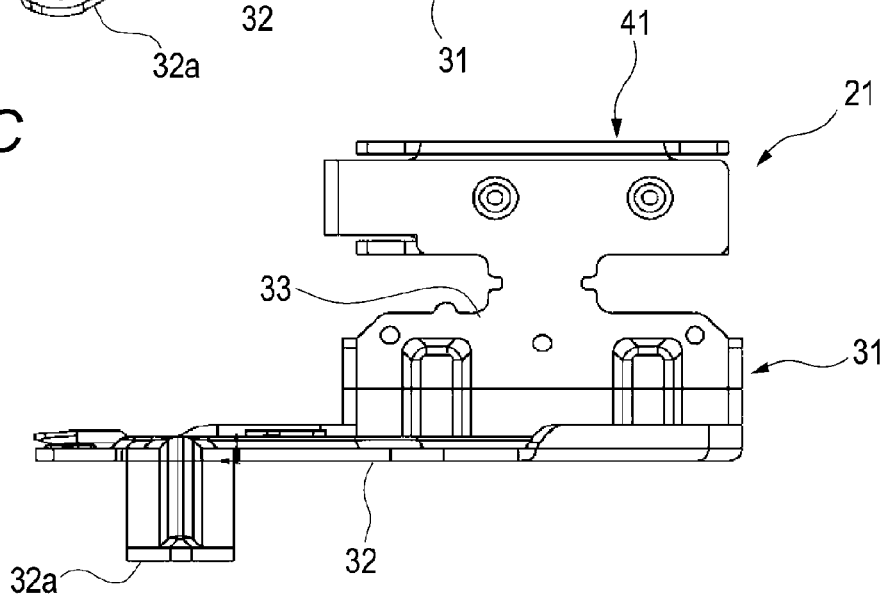

FIGS. 7A to 7C are views showing the connecting member constituting the connector according to the embodiment; FIG. 7A is a perspective view seen from the tip end side thereof, 7B is a perspective view seen from the rear end side thereof, and FIG. 7C is a rear view.

As shown in FIGS. 7A to 7C, the connecting member 21 includes a bus bar 31 and a terminal fitting 41. The bus bar 31 and the terminal fitting 41 are, for example, made of a conductive metal material, such as copper or copper alloy, and integrally formed by press work.

The bus bar 31 has a fastening plate section 32 having a flat plate shape and a supporting plate section 33 rising from this fastening plate section 32. A bolt insertion hole 34 is formed in the fastening plate section 32. A bolt (not shown) inserted into the bolt insertion hole 34 is fastened to the body of a vehicle, whereby the fastening plate section 32 is fastened and fixed to the body, whereby the bus bar 31 is grounded. The grounding terminal 2 of a grounding wire 1 is fastened together with the fastening plate section 32 using the bolt (see FIG. 1). A rotation-stopping piece 32*a* is formed at a portion of the fastening plate section 32. The rotation-stopping piece 32*a* is a bent section to be engaged with a stepped section or a hole section provided around a grounding face to which the fastening plate section 32 is fastened with the bolt, and the rotation-stopping piece 32*a* is engaged with the stepped section or the hole section provided around the grounding face, whereby the rotation of the fastening plate section 32 with respect to the grounding face is restricted.

The terminal fitting 41 has a base section 42 and a plurality of tab sections 43. The base section 42 is formed into a flat plate shape, and the tab sections 43 protrude from the edge section of the base section 42 in the same direction. Furthermore, in the connecting member 21, the plurality of tab sections 43 protruding in a direction orthogonal to the face of the supporting plate section 33 are arranged in two stages in the vertical direction.

As shown in FIGS. 6A and 6B, the connecting member 21 is insert-molded in the male housing 12. Hence, the connecting member 21 is integrated with the male housing 12 in a state in which the supporting plate section 33 and the terminal fitting 41 of the bus bar 31 are embedded in the bottom wall 15 for forming the fitting concave section 13 of the male housing 12. Furthermore, the tab sections 43 of the connecting member 21 protrude from the bottom wall 15 into the fitting concave section 13.

As shown in FIGS. 5A and 5B, the connector 11 has opening sections 70A and 70B in the male housing 12. The resin for forming the male housing 12 does not exist in these opening sections 70A and 70B, and portions of the supporting plate section 33 at the bus bar 31 of the connecting member 21 are exposed. The exposed portions, that is, the portions of the supporting plate section 33 of the connecting member 21, are used as connection member holding sections 71A and 71B that are gripped by molds to be used for insert molding. The opening section 70B on the rear end side of the male housing 12 is formed into a concave shape in which the lower side is opened.

Moreover, as shown in FIGS. 4B and 5B, in the connector 11, the side of the connecting member 21 of the male housing 12 on the opposite side in the protruding direction of the tab sections 43 is used as a resin charging gate section 72, and resin for molding the male housing 12 is charged from this resin charging gate section 72.

Next, a case in which the counterpart connector 51 is connected to the connector 11 will be described below.

The tip end of the female housing 52 of the counterpart connector 51 is directed to and brought close to the tip end of the male housing 12 of the connector 11 in order that the counterpart connector 51 is connected to the connector 11. Then, the fitting section 53 of the housing body 55 of the female housing 52 is inserted into the fitting section 53 of the hood section 14 of the male housing 12.

Hence, the tab sections 43 formed at the terminal fitting 41 of the connecting member 21 of the male housing 12 are inserted from the opening section 57 on the tip end side of the housing body 55 of the female housing 52 into the electrical connection sections 62 of the female terminals 61 and held therein, whereby the connecting member 21 is conductively connected to the female terminals 61, and the electric wires 64 are conducted to the connecting member 21. In addition, the respective electric wires 64 are mutually conducted via the connecting member 21. Furthermore, in this state, the engaging section 17 of the locking arm 18 is engaged with the engaging claw 58, whereby the female housing 52 and the male housing 12 are locked in a state of being connected.

In the case that the counterpart connector 51 is removed from the connector 11 that has been connected to the counterpart connector 51 as described above, a jig is used to release the engagement of the engaging section 17 of the locking arm 18 with the engaging claw 58.

In this state, the counterpart connector 51 is pulled apart from the connector 11. Hence, the fitting section 53 of the female housing 52 is extracted from the fitting concave section 13 of the hood section 14 of the male housing 12. As a result, the tab sections 43 of the connecting member 21 are extracted from the electrical connection sections 62 of the female terminals 61, and the conductive connection between the female terminals 61 and the connecting member 21 is released.

Next, a case will be described in which the connector 11 integrated with the connecting member 21 by insert-molding is manufactured.

Figure 8:
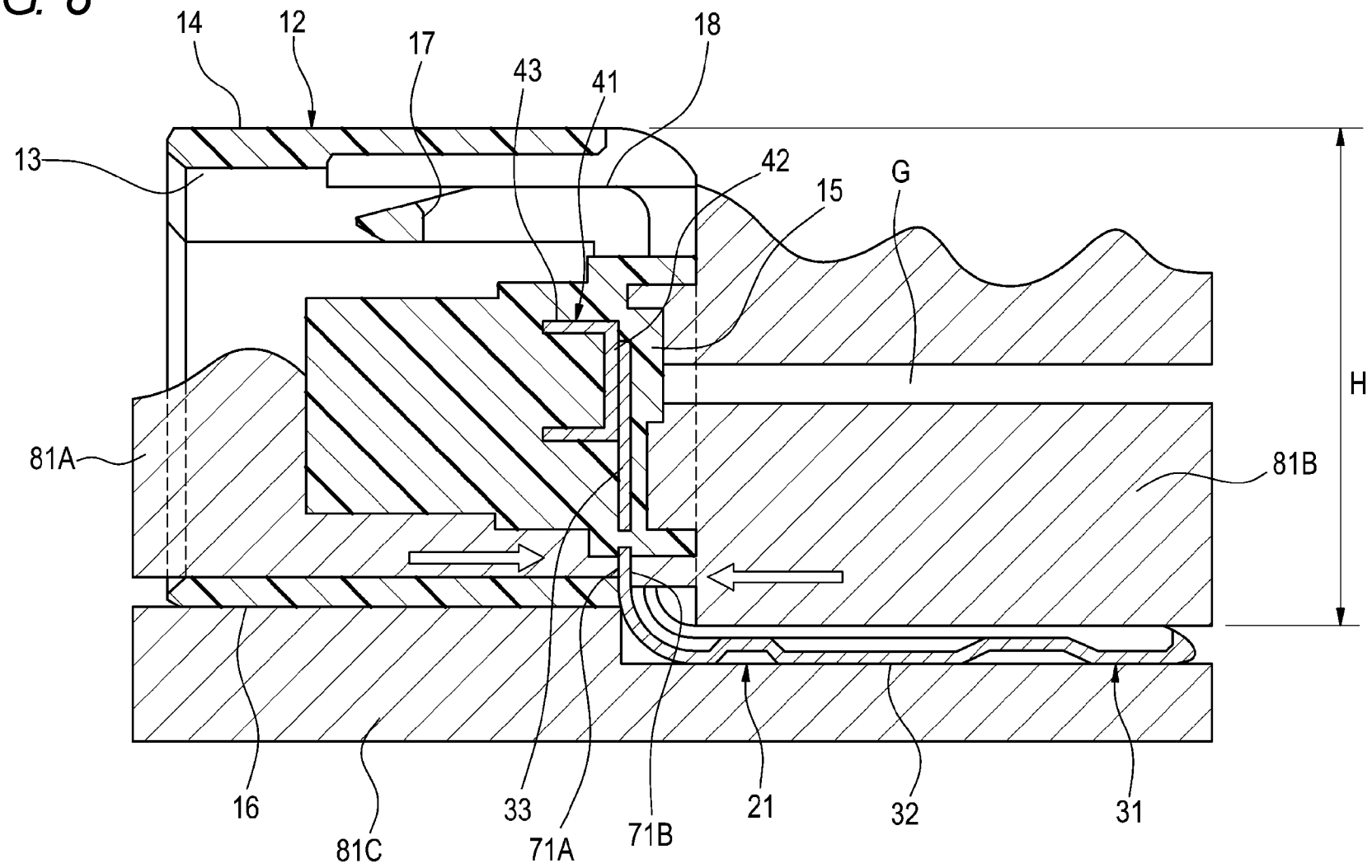
FIG. 8 is a schematic sectional view showing molds and explaining a manufacturing method of the connector according to the embodiment.
Figure 9:
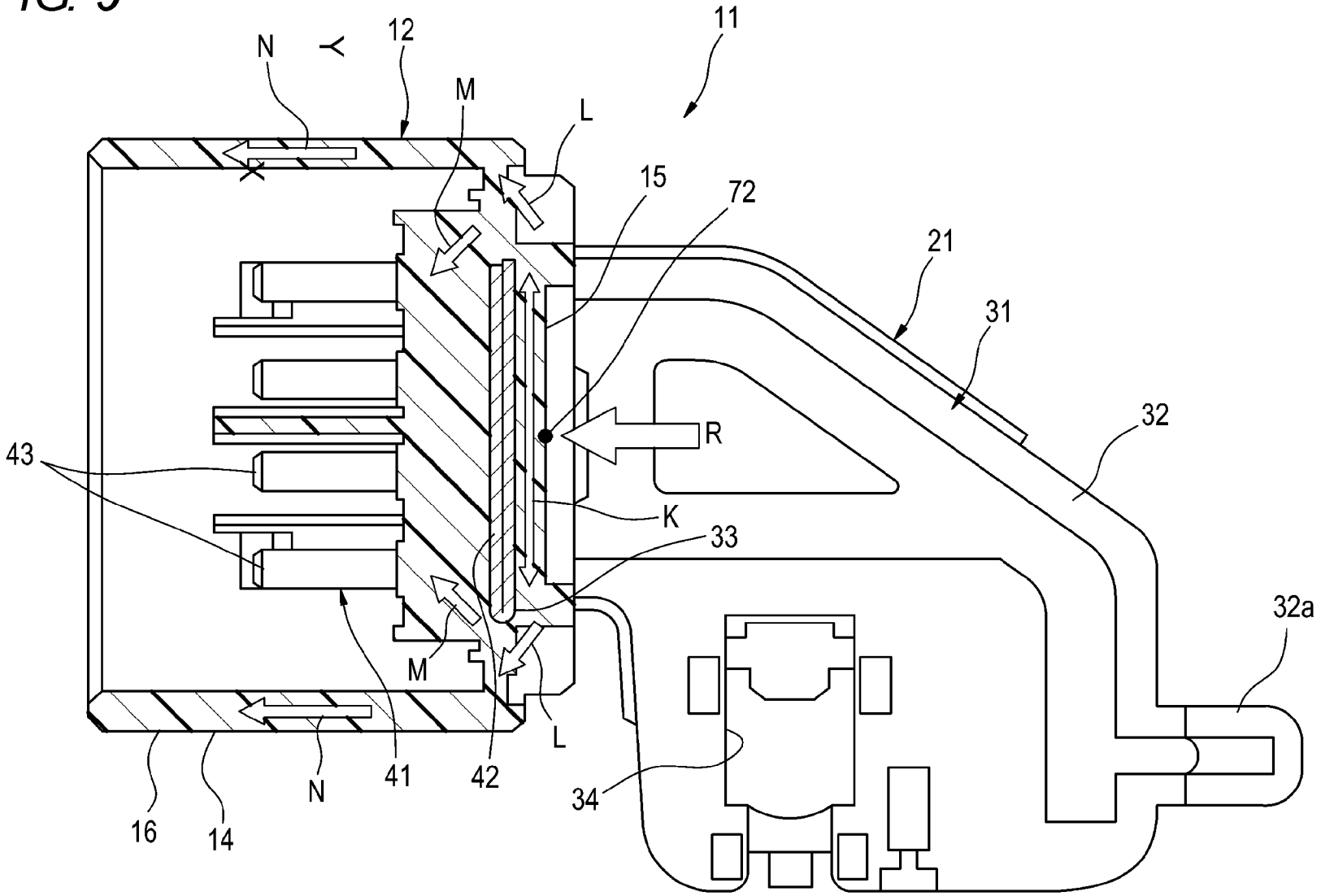
FIG. 9 is a horizontal sectional view showing the connector and indicating the flow of resin.

FIG. 8 is a schematic sectional view showing molds and explaining a manufacturing method of the connector according to the embodiment. FIG. 9 is a horizontal sectional view showing the connector and indicating the flow of resin.

As shown in FIG. 8, molds 81A, 81B and 81C are used to mold the male housing 12 by insert-molding and to manufacture the connector 11. The mold 81A is a forming mold on the front side of the male housing 12, the mold 81B is a forming mold on the rear side of the male housing 12, and the mold 81C is a forming mold on the lower face side of the male housing 12. The mold 81A on the front side of the male housing 12 and the mold 81C on the lower face side thereof are integrated. When these molds 81A, 81B and 81C are used for insert-molding, the connection member holding sections 71A and 71B, that is, the portions of the molding area of the male housing 12, are gripped and supported by the molds 81A and 81C and the mold 81B. In this state, molten resin is injected from the gate G provided on the mold 81B. The gate G is provided at the position on the face of the terminal fitting 41 of the connecting member 21 on the opposite side in the protruding direction of the tab sections 43.

As shown in FIG. 9, when the molten resin is injected from the gate G of the mold 81B (indicated by arrow R in FIG. 9), the resin hits the face of the terminal fitting 41 of the connecting member 21 on the opposite side in the protruding direction of the tab sections 43, and then the resin is spread into the resin injection space formed by the molds 81A, 81B and 81C. More specifically, the resin flows in the vertical direction and the left-right direction on the face of the terminal fitting 41 of the connecting member 21 on the opposite side in the protruding direction of the tab sections 43 (indicated by arrows K and L in FIG. 9), goes around to the side of the terminal fitting 41 of the connecting member 21 on the side in the protruding direction of the tab sections 43 (indicated by arrow M in FIG. 9), and flows into the molding space of the hood section 14 (indicated by arrow N in FIG. 9).

Then, after the curing of the resin having being charged into the resin injection space inside the molds 81A, 81B and 81C, the integrated molds 81A and 81C are extracted to the front side of the male housing 12, and the connector 11 is removed from the molds 81A, 81B and 81C. As a result, the connector 11 integrated with the connecting member 21 by insert-molding is obtained.

As described above, with the embodiment, the side of the terminal fitting 41 of the connecting member 21 on the opposite side in the protruding direction of the tab sections 43 is used as the resin charging gate section 72 into which the resin for molding the male housing 12 is charged, and molten resin is injected from the gate G to the resin charging gate section 72. Hence, the charging pressure of the molten resin during the molding of the male housing 12 is applied in the protruding direction of the tab sections 43 of the connecting member 21.

A reference example will herein be described below.

Figure 10A:
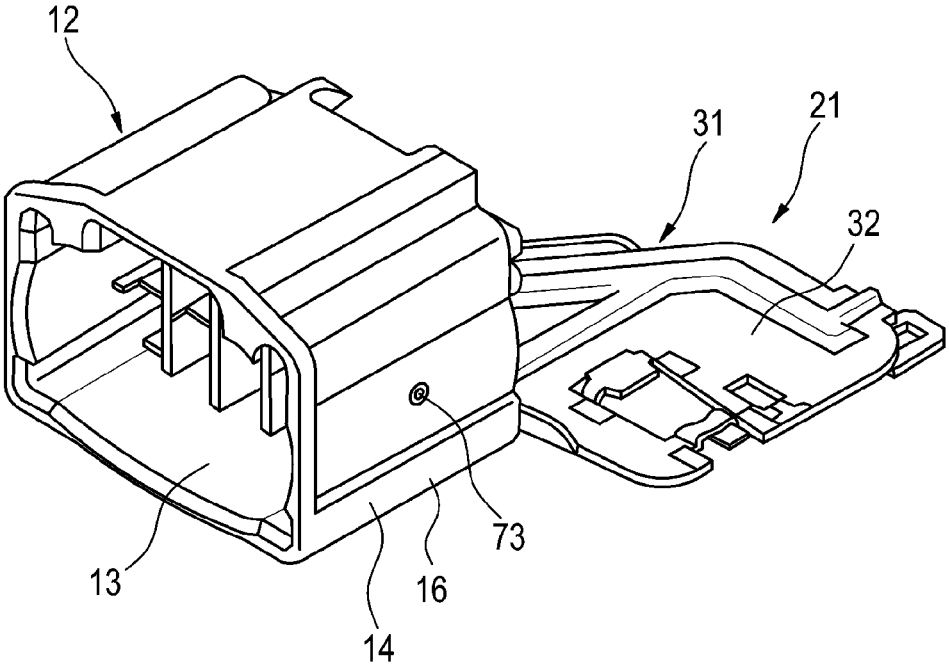
FIGS. 10A and 10B are views showing how a connector according to a reference example is molded.
Figure 10B:
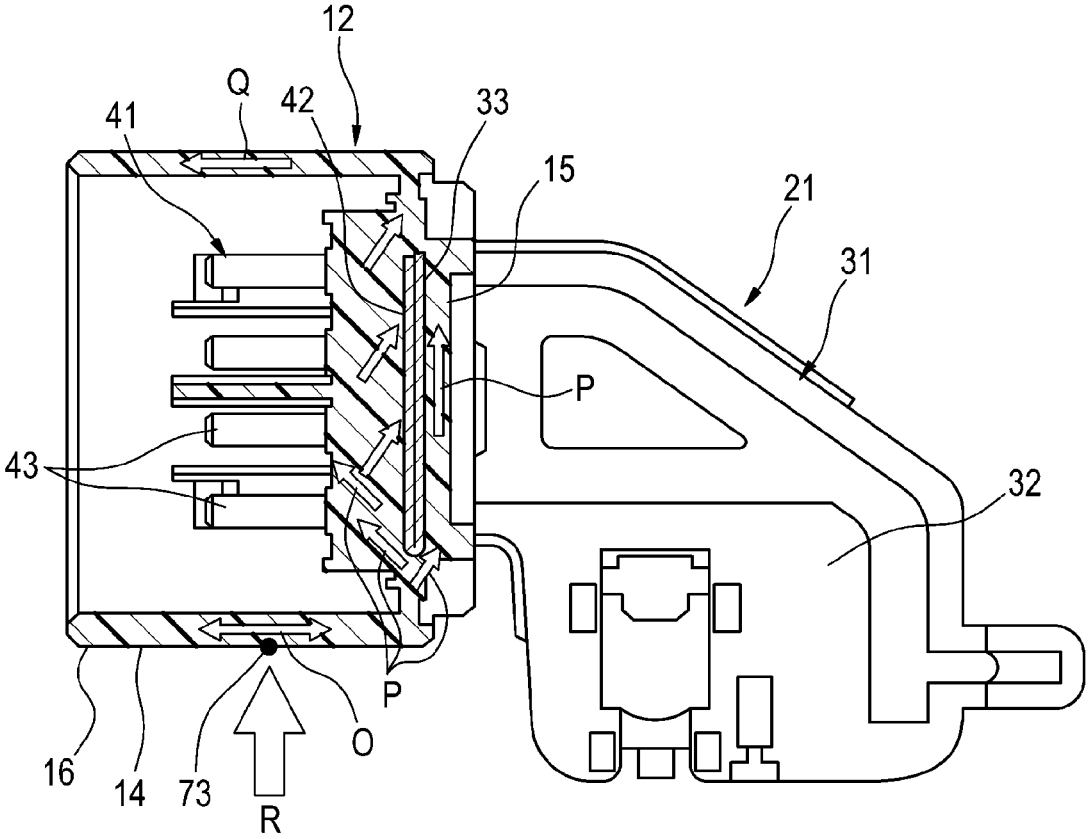

FIGS. 10A and 10B are views showing how a connector according to a reference example is molded; FIG. 10A is a perspective view showing the connector, and FIG. 10B is a horizontal sectional view showing the connector.

As shown in FIGS. 10A and 10B, in the reference example, a resin charging gate section 73 is provided on one side section of the hood section 14 of the male housing 12, and molten resin is charged into this resin charging gate section 73. In the reference example, the molten resin injected to the resin charging gate section 73 (indicated by arrow R in FIG. 10B) goes around from a portion on one side section in the molding space of the hood section 14 to the front and rear (indicated by arrow O in FIG. 10B), flows along the front and back faces of the connecting member 21 in the molding space of the bottom wall 15 from the one side section to the other side section (indicated by arrow P in FIG. 10B), and flows into the other side section in the molding space of the hood section 14 (indicated by arrow Q in FIG. 10B). In the reference example, the charging pressure of the molten resin flowing to the front and back faces of the connecting member 21 in the molding space of the bottom wall 15 is applied complicatedly to the connecting member 21. Hence, the position of the connecting member 21 does not become stable, and the tab sections 43 may be inclined or the extending length thereof in the protruding direction may become insufficient in some cases, whereby a satisfactory state of the connection to the female terminal 61 cannot be secured at the time of the connection to the counterpart connector 51, and the reliability of the connection may be lowered.

On the other hand, with the embodiment, the charging pressure of the molten resin during the molding of the male housing 12 is applied in the protruding direction of the tab sections 43 of the connecting member 21, whereby the connecting member 21 is pressed by the charging pressure of the resin in the protruding direction of the tab sections 43 and held stably at a predetermined position. Hence, the positions of the tab sections 43 do not become unstable, the tab sections 43 are not inclined and the extending length thereof does not become insufficient due to the charging pressure of the molten resin. As a result, the tab sections 43 are disposed accurately at predetermined positions, a satisfactory state of the connection to the female terminals 61 can be secured at the time of the connection to the counterpart connector 51, and high connection reliability can be obtained.

However, the present invention is not limited to the above-mentioned embodiment, but can be modified or improved as necessary. In addition, the materials, shapes, dimensions, quantities, arrangement positions, etc. of the respective components in the above-mentioned embodiment may be arbitrary and not limited, provided that the present invention can be achieved.

The characteristics of the connector and the manufacturing method thereof according to the embodiment of the present invention described above will be briefly summarized and listed in the following items [1] and [2].

[1] A connector (11) including: a connecting member (21) including a plurality of tab sections (43) and made of a conductive metal material; and a housing (12) which is made of resin and in which the connecting member (21) is insert-molded, wherein terminals (61) of a counterpart connector (51) are connectable to the tab sections (43) by a connection of the counterpart connector (51), and wherein a side of the connecting member (21) of the housing (12) opposite to a protruding direction of the tab sections (43) is used as a resin charging gate section (72) from which the resin is charged.

[2] A manufacturing method of a connector (11), the connector including: a connecting member (21) including a plurality of tab sections (43) and made of a conductive metal material; and a housing (12) which is made of resin and in which the connecting member (21) is insert-molded, wherein terminals (61) of the counterpart connector (51) being connected to the tab sections (43) by the connection of the counterpart connector (51), the manufacturing method comprising: holding the connecting member (21) in a mold (81A, 81B, 81C) for molding the housing (12); and molding the housing (12) by charging molten resin into the mold (81A, 81B, 81C) from a gate (G) provided in the mold (81A, 81B and 81C) on a side of the connecting member (21) opposite to a protruding direction of the tab sections (43).

What is claimed is:

1. A connector comprising:

a connecting member comprising a plurality of tab sections and made of a conductive metal material; and a housing which is made of resin and in which the connecting member is insert-molded, wherein terminals of a counterpart connector are connectable to the tab sections by a connection of the counterpart connector, and wherein a side of the housing opposite to a protruding direction of the tab sections includes a resin charging gate section from which the resin is charged.

2. A manufacturing method of a connector, the connector comprising:

a connecting member including a plurality of tab sections and made of a conductive metal material; and a housing which is made of resin and in which the connecting member is insert-molded, wherein terminals of a counterpart connector being connected to the tab sections by the connection of the counterpart connector, said manufacturing method comprising:

holding the connecting member in a mold for molding the housing;

providing a gate on a side of the mold that is opposite to a protruding direction of the tab sections; and molding the housing by charging molten resin into the mold from the gate.

* * * * *